US007469618B2

(12) United States Patent
Bandi

(10) Patent No.: US 7,469,618 B2
(45) Date of Patent: Dec. 30, 2008

(54) MAINTAINING CARBURIZED CASE DURING NEUTRAL TO THE CORE HEAT TREATMENT PROCESSES

(75) Inventor: Manikiran Bandi, Pearland, TX (US)

(73) Assignee: Smith International, Inc., Houston, TX (US)

( * ) Notice: Subject to any disclaimer, the term of this patent is extended or adjusted under 35 U.S.C. 154(b) by 322 days.

(21) Appl. No.: 11/211,261

(22) Filed: Aug. 25, 2005

(65) Prior Publication Data

US 2006/0042837 A1 Mar. 2, 2006

Related U.S. Application Data

(60) Provisional application No. 60/605,976, filed on Aug. 31, 2004.

(51) Int. Cl.
*E21B 10/22* (2006.01)

(52) U.S. Cl. ..... 76/108.2; 175/371

(58) Field of Classification Search ..... 76/108.2; 175/374, 371

See application file for complete search history.

(56) References Cited

U.S. PATENT DOCUMENTS

| | | | | |
|---|---|---|---|---|
| 2,589,811 | A | | 3/1952 | Holcroft |
| 2,713,480 | A | | 7/1955 | Ruckstahl |
| 2,998,237 | A | | 8/1961 | De Coriolis et al. |
| 3,189,336 | A | | 6/1965 | Montagino |
| 3,275,389 | A | * | 9/1966 | Neilson et al. ..... 384/95 |
| 3,356,541 | A | | 12/1967 | Cullen |
| 3,662,996 | A | | 5/1972 | Schwalm et al. |
| 3,836,380 | A | | 9/1974 | Kramer |
| 3,913,988 | A | * | 10/1975 | Scales et al. ..... 384/95 |
| 4,012,238 | A | | 3/1977 | Scales |
| 4,036,670 | A | | 7/1977 | De Walt |
| 4,188,242 | A | | 2/1980 | Scales |
| 4,227,945 | A | | 10/1980 | Kitayama et al. |

(Continued)

FOREIGN PATENT DOCUMENTS

GB 1455951 11/1976

(Continued)

OTHER PUBLICATIONS

British Search Report for Appl. No. GB0620054.7 dated Oct. 25, 2006; (3 p.).

(Continued)

*Primary Examiner*—Hoang Dang
(74) *Attorney, Agent, or Firm*—Conley Rose, P.C.

(57) ABSTRACT

The preferred embodiments are directed toward methods and apparatus for manufacturing components for earth-boring drill bits. In the preferred embodiments, a portion of the component is coated and the component is exposed to a carbon-rich environment at an elevated temperature. During this exposure, some portions of the component are not coated. The preferred embodiments further comprise coating the areas that were exposed to the carbon-rich environment and exposing the component to an elevated temperature in an environment with carbon present. In one embodiment, a drill leg is coated (with the exception of the journal pin) and then exposed to a carbon-rich environment at an elevated temperature. In this embodiment, the journal pin is then coated and the drill leg is exposed to an elevated temperature with a percentage of carbon that is less than the initial carbon-rich environment.

14 Claims, 3 Drawing Sheets

U.S. PATENT DOCUMENTS

| | | | | | |
|---|---|---|---|---|---|
| 4,303,137 | A | * | 12/1981 | Fischer | 175/374 |
| 4,622,006 | A | | 11/1986 | Hohne | |
| 4,708,752 | A | * | 11/1987 | Kar | 148/525 |
| 4,726,432 | A | * | 2/1988 | Scott et al. | 175/375 |
| 4,763,880 | A | | 8/1988 | Smith et al. | |
| 4,867,015 | A | | 9/1989 | Kane et al. | |
| 4,921,025 | A | | 5/1990 | Tipton et al. | |
| 5,324,366 | A | | 6/1994 | Keil et al. | |
| 5,407,180 | A | | 4/1995 | Keil et al. | |
| 5,975,223 | A | * | 11/1999 | Karlsson | 175/374 |
| 6,374,704 | B1 | * | 4/2002 | Scott et al. | 76/108.2 |
| 6,444,053 | B1 | | 9/2002 | Spitsberg et al. | |

FOREIGN PATENT DOCUMENTS

| | | |
|---|---|---|
| GB | 1559690 | 1/1980 |

OTHER PUBLICATIONS

British Search Report for Appln. No. GB0517743.1; dated Nov. 16, 2005; (pp. 3).

* cited by examiner

MAINTAINING CARBURIZED CASE DURING NEUTRAL TO THE CORE HEAT TREATMENT PROCESSES

CROSS-REFERENCE TO RELATED APPLICATIONS

The present application claims the benefit of 35 U.S.C. 111(b) provisional application Ser. No. 60/605,976 filed Aug. 31, 2004, and entitled Maintaining Carburized Case During Neutral To The Core Heat Treatment Processes

STATEMENT REGARDING FEDERALLY SPONSORED RESEARCH OR DEVELOPMENT

Not Applicable.

BACKGROUND OF THE INVENTION

1. Field of the Invention

The invention relates generally to earth-boring drill bits. More particularly, the invention relates to increasing the reliability and manufacturing efficiency of earth-boring drill bits. Still moreh particularly, the invention relates to maintaining desired carbon percentages in a material during heat treatment processes performed subsequent to carburization.

2. Description of the Related Art

An earth-boring drill bit is typically mounted on the lower end of a drill string and is rotated by revolving the drill string. With weight applied to the drill string, the rotating drill bit engages the earthen formation and proceeds to form a borehole along a predetermined path toward a target zone. A typical earth-boring bit includes one or more rotatable cone cutters that perform their cutting function due to the rolling movement of the cone cutters acting against the formation material. The cone cutters roll and slide upon the bottom of the borehole as the drillstring and bit are rotated, the cone cutters thereby engaging and disintegrating the formation material in their path. The rotatable cone cutters may be described as generally conical in shape and are therefore referred to as rolling cones.

Rolling cone bits typically include a bit body with a plurality of journal segment legs. The cones are mounted on bearing pin shafts (also called journal shafts or journal pins) that extend downwardly and inwardly from the journal segment legs. As the bit is rotated, cutter elements or teeth that extend from the cone cutters remove chips of formation material ("cuttings" or "drilled solids") which are carried upward and out of the borehole by the flow of drilling fluid which is pumped downwardly through the drill pipe and out of the bit.

The cost of drilling a borehole is proportional to the length of time it takes to drill to the desired depth and location which, in turn, is greatly affected by the number of times the drill bit must be changed in order to reach the targeted formation. This is the case because each time the bit is changed, the entire string of drill pipes—which in oil and gas well drilling may be miles long—must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. The amount of time required to make a round trip for replacing a bit is essentially lost time and lost productivity from drilling operations. It is therefore advantageous to employ drill bits that will be durable enough to drill for a substantial period of time with acceptable rates of penetration (ROP) so as to minimize the number of "trips" and the associated lost productivity.

One cause of bit failure arises from the severe wear or damage that may occur to the bearing surfaces on which the cone cutters are mounted. It is therefore desirable to maintain a hard surface on the journal shaft or pin to minimize wear and damage, and thereby minimize the need to trip the drill string. One method used to increase the surface hardness of the journal shaft is to carburize the area. Carburization is well known in the art, and generally comprises heating the material to an elevated temperature (approximately 1750 degrees Fahrenheit) in a carbon-rich environment (approximately 0.6% to 0.9% carbon, depending on the material being treated). This allows carbon to diffuse into the surface, thereby increasing the hardness of the material.

While carburization provides good surface hardness, it does not produce a material that has other desirable mechanical properties, such as ductility. In order to improve the mechanical properties of the material used to manufacture earth-boring drill bits, it is common to "heat treat" the material. This involves heating the material to a temperature of approximately 1500 degrees Fahrenheit, and then rapidly cooling, as by quenching. This has the effect of increasing the hardness of all of the material, not just the surface, as is accomplished via carburization. The final heat treatment step typically conducted in the manufacture of an earth-boring drill bit is to temper the material at a temperature of approximately 400 degrees Fahrenheit to increase the toughness and ductility of the material.

During the heat treatment steps performed subsequent to carburization, it is desirable to maintain the high carbon concentrations in the carburized areas to provide improved wear characteristics. It is also desirable during these steps to prevent excess carbon from diffusing into the areas that were not carburized because excess carbon in these areas can decrease the ductility of the material and lead to reduced fatigue properties and increased likelihood of the material developing cracks.

In the prior art, the process of carburization and subsequent heat treatment is therefore performed in the following basic steps. First, the portions of the drill leg that are not intended to be carburized are painted, while the areas that will be carburized (i.e. the journal pin surfaces) are left exposed. The drill leg is then subjected to the carburization process by exposing the leg to an elevated temperature in a carbon-rich environment. After carburization, any defects or breaches in the painted areas of the drill leg are repainted, while the carburized areas are still left exposed. Finally, the drill leg is heat treated at an elevated temperature in an environment having a carbon percentage that is substantially the same as the carburization environment. This carbon-rich environment is again employed in order to prevent the carbon that diffused into the surface of the carburized surfaces during carburization from "reversing" itself and diffusing out of the surface and into the atmosphere surrounding the part. With respect to the percentage of carbon, this environment surrounding the part during heat treating is known as "neutral to the case".

As mentioned, by performing the subsequent heat treatment in such an environment, there is a reduced tendency for the carbon to diffuse from the journal pin into the environment. One problem with using the high carbon environment in this conventional process is that the coating or paint on the painted areas of the drill leg must be maintained so that no areas of the base material are exposed. If any portion of the base material is exposed to the carbon-rich environment during the carburization or heat treatment processes, excess carbon will be diffused into the exposed portion. Such diffusion will result in the exposed area's mechanical properties, such as ductility and fatigue strength, being lowered. In turn, such a resultant decrease in mechanical strength increases the likelihood that drill leg will break during operation, resulting in increased downtime and operating costs.

The intricate shape of the drill leg increases the likelihood that a portion of the drill leg will be unintentionally exposed during the carburization or heat treatment processes. Furthermore, the handling and transporting of the drill leg during the carburization and heat treatment steps increases the possibility of breaching the protective coating or paint. In addition, the time period between the carburization and heat treatment can be significant, further increasing the likelihood that a portion of the painted area will be exposed during handling, for example.

Thus, the embodiments of the present invention are directed toward methods and apparatus for maintaining carbon concentrations in the carburized areas of the drill bit during subsequent heat treatment processes. Furthermore, embodiments of the present invention are directed towards methods and apparatus to prevent carbon diffusion into those non-carburized areas of the drill bit during subsequent heat treatment processes.

SUMMARY OF THE PREFERRED EMBODIMENTS

The preferred embodiments are directed toward methods and apparatus for manufacturing components for earth-boring drill bits. In the preferred embodiments, a portion of the component is coated and the component is exposed to a carbon-rich environment at an elevated temperature. During this exposure, some portions of the component remain uncoated. The preferred embodiments further comprise coating the previously-uncoated areas that were exposed to the carbon-rich environment, and exposing the component to an elevated temperature in an environment with carbon present.

In one embodiment, a drill leg is coated (with the exception of the journal pin) and then exposed to a carbon-rich environment at an elevated temperature to allow the uncoated journal pin to absorb carbon to increase the hardness of its outer surface. The surface hardness of the coated portion is not increased. Thereafter, in this embodiment, the journal pin is then coated (to prevent carbon from diffusing from the pin to the environment) and the drill leg is placed in an environment with an elevated temperature and a percentage of carbon that is less than the initial carbon-rich environment.

BRIEF DESCRIPTION OF THE DRAWINGS

For a more detailed description of the preferred embodiments of the present invention, reference will now be made to the accompanying drawings, wherein.

DESCRIPTION OF EXEMPLARY PREFERRED EMBODIMENTS

Figure 1:
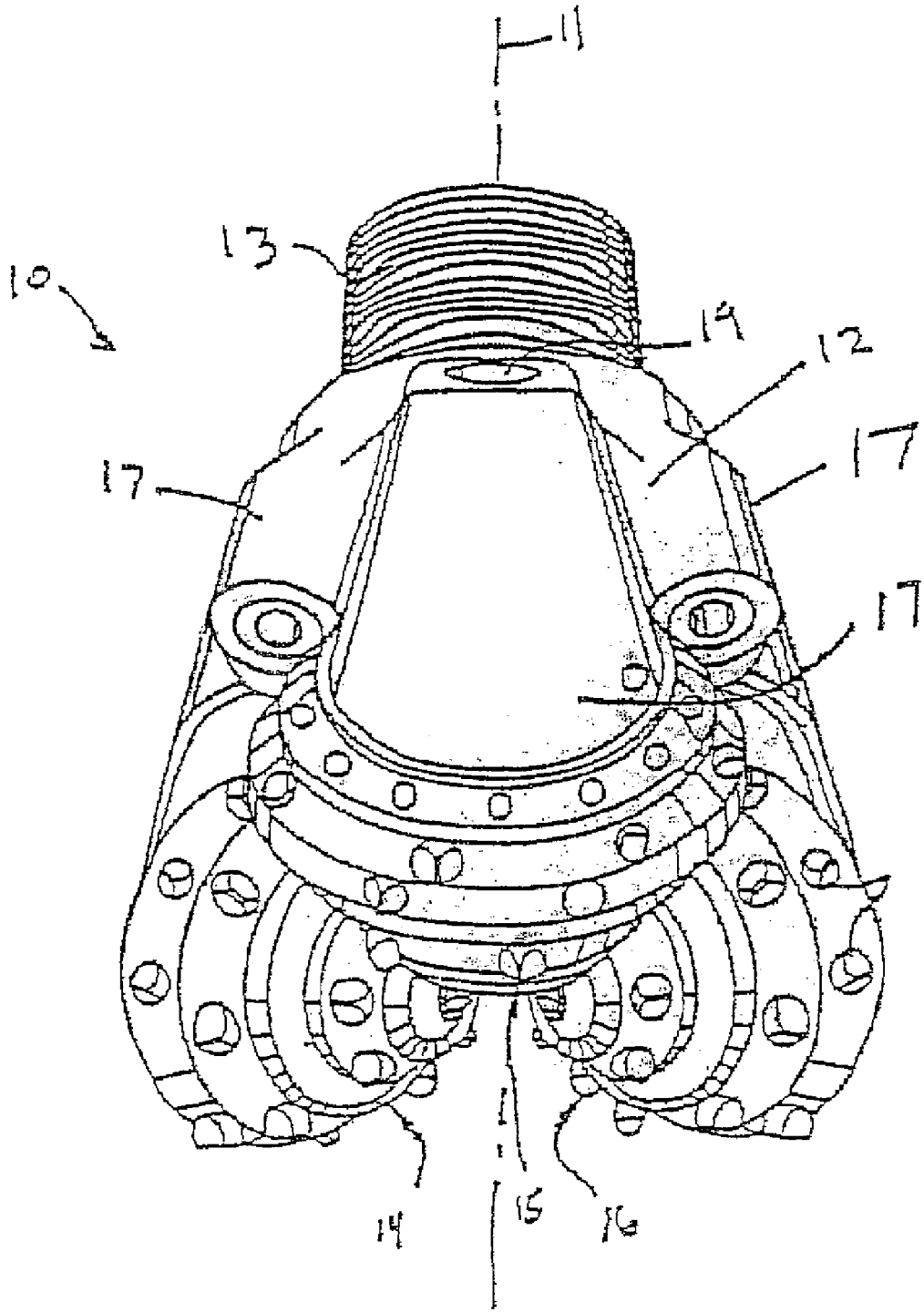
FIG. 1 is an earth-boring drill bit.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In particular, various embodiments described herein thus comprise a combination of features and advantages intended to overcome some of the deficiencies or shortcomings of prior art methods and apparatus used in the manufacturing of drill bit components. The various characteristics mentioned above, as well as other features and characteristics described in more detail below, will be readily apparent to those skilled in the art upon reading the following detailed description of preferred embodiments, and by referring to the accompanying drawings.

The preferred embodiments of the present invention include a drill leg of a drill bit in which the percentages of carbon in portions of the drill leg have been altered (from the base material), depending on the desired material properties. Referring first to FIG. 1, an earth-boring bit 10 includes a central axis 11 and a bit body 12. Body 12 includes a threaded portion 13 on its upper end for securing the bit to the drillstring (not shown). Bit body 12 is composed of three sections or drill legs 17 that are joined together to form bit body 12. Rotatably mounted to body 12 are three rolling cone cutters, 14, 15, 16. Each cone cutter 14-16 is rotatably mounted on a journal pin 18 (shown in FIG. 2) that is oriented generally downward and inward toward the center of bit 10. Each journal pin 18 and each cone cutter 14-16 is substantially the same, such that the description of one such journal pin 18 and one cone cutter 14 will adequately describe the others.

It is to be understood that journal pins and drill legs are described herein with respect to a three cone bit for purposes of example only, and that the journal pins and drill legs described herein may be employed in single cone bits, as well as in bits having two or more cones. Likewise, the methods described herein may have application beyond rolling cone drill bits, and may be used wherever it is required to maintain a high carbon concentration in a surface during heat treatment processes.

Figure 2:
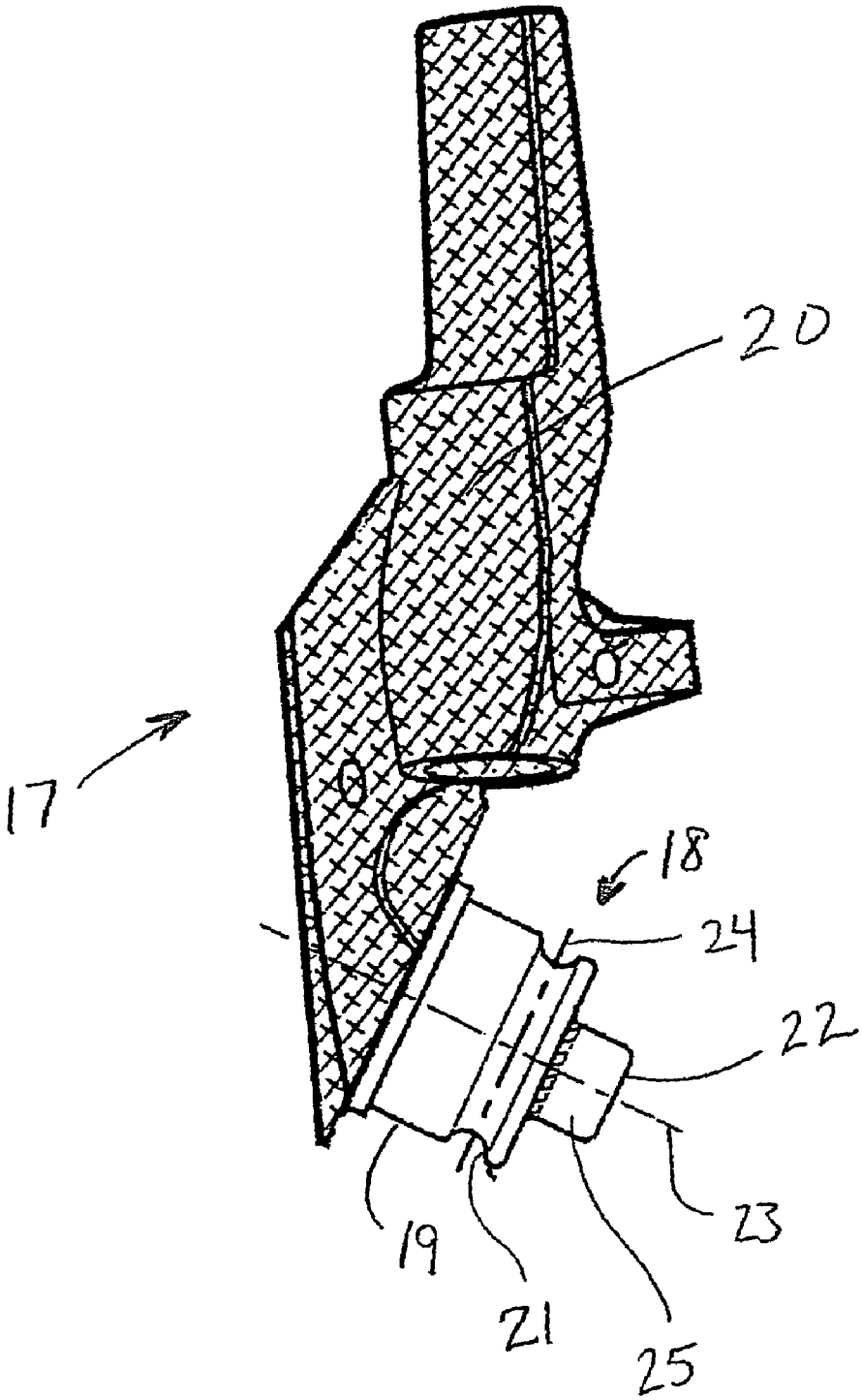
FIG. 2 is a side view of a drill leg.

Referring now to FIG. 2, a side view of a single drill leg 17 is shown. In FIG. 2, cone cutter 14 is not displayed so that journal pin (or shaft) 18 is visible. Journal pin 18, having longitudinal axis 23, extends generally downward and away from the outer surface of drill leg 17. Journal pin 18 comprises a generally cylindrical bearing surface 19 for supporting a load placed on journal pin 18 as bit 10 drills into a formation (not shown). Journal pin 18 also comprises a spindle portion 25, of reduced diameter at the lower end 22 of pin 18. Pin 18 further comprises an annular groove or ball race 21 between bearing surface 19 and spindle portion 25. When pin 18 and cone cutter 14 are fully assembled, ball bearings (not shown) are distributed around a ball race 21 along radial axis 24. The ball bearings lock the cone cutter 14 on the pin 18 and assist in carrying both radial and axial loads placed on journal pin 18 during operation of earth-boring bit 10.

As previously mentioned, one cause of bit failure arises from the severe wear or damage that may occur to load-bearing surfaces on which cone cutter 14 is mounted. These surfaces include, among others, bearing surface 19 and bearing race 21. It is therefore desired that the hardness of bearing surface 19 and bearing race 21 be increased to reduce the wear or damage caused during operation. Reducing the wear and damage to the load-bearing surfaces of journal pin 18 is desired in order to decrease the number of times the drillstring will need to be tripped, resulting in substantial economic savings.

One method of increasing the hardness of bearing surface 19 and bearing race 21 is through a process known as carburization. As previously explained, carburization involves placing a material in a carbon-rich environment with an elevated temperature. During this process, carbon is diffused from the environment into surface of the material, thereby increasing the hardness up to a depth of approximately 0.050 inches to 0.100 inches. While the increased carbon results in a harder material, it also reduces other desirable mechanical properties, such as ductility and fatigue strength. Therefore, the areas of drill leg 17 that are not intended to be carburized are first coated with paint or another suitable substance to prevent the diffusion of carbon into the coated areas. The areas of drill leg 17 that are not to be carburized (in this example) are shown hatched or shaded in FIG. 2 as painted area 20. During the carburization process, carbon is prevented from diffusing into painted area 20. Because there is no coating or paint on journal pin 18, the percentage of carbon in the surface of journal pin 18, including bearing surface 19 and bearing race 21, increases due to the diffusion of carbon into the uncoated areas. This increase in carbon increases the hardness and improves the wear characteristics of the surface of journal pin 18.

Other mechanical properties of journal pin 18, such as ductility and fatigue strength, may be improved by the heat treatment process previously described. Specifically, the material can be heated to approximately 1500 degrees Fahrenheit and then rapidly cooled. The material can then be tempered at a temperature of approximately 400 degrees Fahrenheit. During these heat treatment steps, the high levels of carbon in journal pin 18 need to be maintained so that the improved wear properties achieved during the carburization are not lost.

Embodiments of the present invention are intended to overcome problems associated with prior art heat treatment processes by performing the heat treatment steps in an environment with a carbon percentage that is reduced as compared to prior art methods. Specifically, the percentage of carbon in the heat treatment environment is approximately 0.13% to 0.22%, similar to that found in the base material of painted area 20, so that loss of protective paint on non-carburized areas is of no consequence. With respect to the percentage of carbon, this environment is known as "neutral to the core". Therefore, any breach in the coating or paint of painted area 20 which occurs after the carburization process will not cause carbon to diffuse from the environment into the material.

The steps of one embodiment of the present invention may be summarized as follows. First, as in the prior art, the portions of drill leg 17 that are not intended to be carburized are painted, while the areas that will be carburized (i.e. surfaces of journal pin 18) are left exposed. The partially painted drill leg 17 is then subjected to the carburization process by exposing it to an elevated temperature in a carbon-rich environment (for example, 1750 degrees Fahrenheit and 0.6% to 0.9% carbon). In this embodiment of the present invention, unlike the prior art, the previously-carburized areas of drill leg 17 journal pin 18 in this specific example) are then coated or painted after carburization. Drill leg 17 is then heat treated at an elevated temperature (approximately 1500 degrees Fahrenheit) in an environment with a carbon percentage of approximately 0.13% to 0.22% that is substantially the same as the base material of drill leg 17 (which has not been carburized). Employing this technique, the previously-carburized areas (i.e. journal pin 18) must be coated or painted to prevent carbon (enhanced or "added" via the carburization process) from diffusing from journal pin 18 to the environment during heat treatment. In this embodiment of the invention, the coating or painting of journal pin 18 is necessary because the heat treatment environment is at a lower carbon percentage than the carburized material of journal pin 18, and if the material is not coated, carbon "added" during the carburization to enhance the wear resistance or hardness of the journal pin will diffuse or migrate out of the material, decreasing the desired wear resistance.

Embodiments of the present invention incorporate numerous advantages over the prior art. For example, journal pin 18 is much smaller and less intricate than painted area 20 of bit leg 17, so it is easier to ensure that the coating or paint on pin 18 is not breached due to chips or cracks. In addition, performing the heat treatment steps in an environment that is "neutral to the core" removes excess carbon from any portions of painted area 20 that were unintentionally left exposed during the carburization process and improves the mechanical properties (such as fatigue strength and ductility) of those exposed portions. Because, in this example, the percentage of carbon in the heat treatment environment is now approximately the same as the base material, excess carbon in any exposed portions of painted area 20 will diffuse into the environment. In addition, any portions of painted area 20 that become exposed after carburization (areas where the paint has chipped off due to unintentional impacts, for example) do not need to be re-coated or re-painted before the heat treatment steps. Because the heat treatment environment employs a percentage of carbon that is substantially equivalent to that of the base material, there should not be a change in the carbon percentage of these portions of painted area 20 that are exposed during the heat treatment steps.

Embodiments of the present invention also allow the machining steps needed during the manufacturing of drill leg 17 to be performed at more optimal stages in the production of drill leg 17. More specifically, in prior art methods, various machining steps (including the drilling of numerous bores and passageways) are typically performed after the material had been painted and hardened via the heat treatment processes. This makes the machining and drilling operations more difficult to perform due to the increased hardness of the material subsequent to heat treatment. The alternative in prior art methods is to perform the machining and drilling after carburization but before the heat treatment. However, such drilling or other machining leads to many breaches in the painted area 20 of drill leg 17. In such instances, the holes and machined areas would then have to be re-coated or re-painted before the heat treatment process was performed to prevent carbon in the conventional carbon-rich environment from diffusing into the unpainted areas and undesirably decreasing the ductility and fatigue strength of the material. As the drilling and machining becomes more intricate, it is more difficult to ensure that the coating or painting completely covers the surface of the material.

Figure 3:
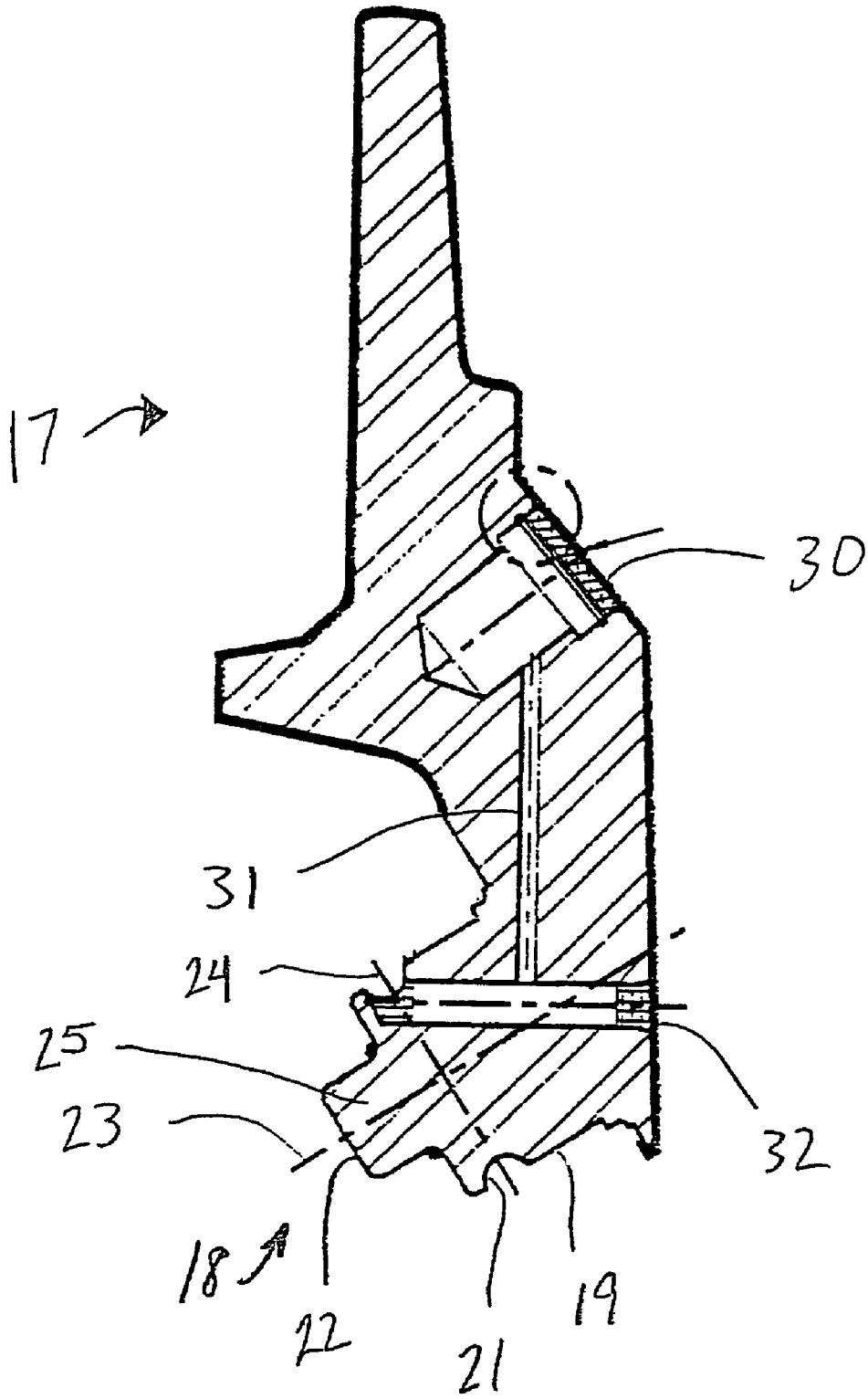
FIG. 3 is a section view of a drill leg.

As shown in FIG. 3, drill leg 17 includes numerous holes and ports upon completion of the machining and drilling as are needed to complete the manufacture of drill leg 17. These include grease reservoir 30, grease port 31, and ball hole 32. The machining and drilling of these features is made more difficult if performed after the material has been hardened via a conventional heat treatment process. As stated, if the these features are instead machined and drilled prior to heat treatment, they then must be re-coated or re-painted if the heat treatment is performed in the conventional process in which an environment with a higher carbon percentage than the base material is used. It is difficult to ensure that areas such as grease port 31, which are not visible upon an external inspection, are adequately coated or painted.

Embodiments of the present invention allow the machining and drilling of features such as grease reservoir 30, grease port 31, and ball hole 32 to be performed before the material is hardened during heat treatment. In addition, embodiments of the present invention eliminate the need to re-coat or re-paint the machined or drilled areas prior to heat treating. Performing the machining and drilling prior to hardening the material is preferable because it results in less wear on drill bits and machine tools. As previously stated, embodiments of the present invention utilize a heat treatment environment and carbon content that is approximately the same as that found in the base material of painted area 20. Therefore, there is no need to re-paint or re-coat the areas exposed by drilling and machining prior to the heat treatment. Any portions of painted area 20 that are exposed after carburization and during the heat treatment process will not experience a gain or loss of carbon, due to the equilibrium between the exposed material and the heat treatment environment.

As previously mentioned, the above-described embodiment of the present invention contemplates that journal pin 18 be coated or painted before the heat treatment processes, an extra step in comparison to typical prior art methods. However, this additional step over the conventional process (which did not include this step but did include the step of repainting machined areas and heat treating in an environment that is "neutral to the case") is more than offset by the advantages described above, including the elimination of the need to re-coat or re-paint exposed areas of drill leg 17 that were not intended to be carburized, and the benefit of performing drilling and machining operations prior to heat treatment. Embodiments of the present invention therefore may effect increased efficiency in the manufacture of drill leg 17 as compared to prior art manufacturing methods. In addition, embodiments of the present invention have the potential to improve the reliability of bit 10 by reducing the likelihood that excess carbon will be introduced into portions of drill leg 17 during heat treatment. Embodiments of the present invention also have the potential to improve the reliability of bit 10 by reducing carbon in areas that were unintentionally exposed during carburization.

While various preferred embodiments of the invention have been shown and described, modifications thereof can be made by one skilled in the art without departing from the spirit and teachings of the invention. The embodiments herein are exemplary only, and are not limiting. Many variations and modifications of the apparatus and methods disclosed herein are possible and within the scope of the invention. For example, as used herein, the terms "paint" or "coat" (and variations thereof) are intended to be interpreted broadly, so as to include other means of covering the surface of a material in order to prevent the diffusion of carbon to or from the material. In addition, other embodiments of the present invention may involve components other than a drill leg and journal pin of an earth-boring drill bit. Accordingly, the scope of protection is not limited by the description set out above, but is only limited by the claims which follow, that scope including all equivalents of the subject matter of the claims.

What is claimed is:

1. A method of manufacturing a component for a drill bit, comprising the following steps:

coating a first surface of the component while leaving a second surface of the component uncoated;

exposing the component to a first elevated temperature in an environment with a first concentration of carbon;

coating the second surface of the component; and exposing the component to a second elevated temperature in an environment with a second concentration of carbon;

wherein the first carbon concentration is approximately 0.6% to 0.9% and the second carbon concentration is approximately 0.13% to 0.22%.

2. The method of claim 1, wherein the component is a drill leg comprising a journal pin.

3. The method of claim 2, wherein the first surface comprises an area outside of the journal pin and the second surface comprises a portion of the journal pin.

4. The method of claim 1, further comprising increasing a percentage of carbon in the second surface by exposing the component to the first concentration of carbon, wherein the first concentration of carbon is greater than the percentage of carbon that is in the second surface at the time before exposing the component to the first concentration of carbon.

5. The method of claim 1, wherein the second temperature is less than the first temperature.

6. The method of claim 1, wherein the second carbon concentration is less than the first carbon concentration.

7. The method of claim 6 further comprising reducing the diffusion of carbon from the second surface during exposure of the component to the second concentration of carbon by coating the second surface before exposing the component to the second concentration of carbon.

8. The method of claim 1, wherein the first temperature is approximately 1750 degrees Fahrenheit and the second temperature is approximately 1500 degrees Fahrenheit.

9. The method of claim 1, wherein the first carbon concentration is greater than four times the second carbon concentration.

10. The method of claim 1, further comprising the step of:

machining or drilling a portion of the first surface area, wherein said machining or drilling is performed after exposing the component to a first elevated temperature in an environment with a first concentration of carbon and said machining or drilling is performed before exposing the component to a second elevated temperature in an environment with a second concentration of carbon.

11. A method of manufacturing a component for a drill bit, comprising the following steps:

coating a first surface of the component while leaving a second surface of the component uncoated;

exposing the component to a first elevated temperature in an environment with a first concentration of carbon;

coating the second surface of the component; and exposing the component to a second elevated temperature in an environment with a second concentration of carbon;

wherein the second carbon concentration is approximately equivalent to a percentage of carbon in the first surface before exposing the component to the first concentration of carbon.

12. A method of manufacturing a component for a drill bit, comprising the following steps:

(a) coating a first surface of the component while leaving a second surface of the component uncoated;

(b) exposing the component to a first elevated temperature in an environment with a first concentration of carbon of 0.6%-0.9%;

(c) coating the second surface of the component;

(d) machining or drilling a portion of said first surface after step (b);

(e) exposing the component to a second elevated temperature in an environment with a second concentration of carbon after step (c) wherein said second concentration of carbon is less than said first concentration of carbon.

13. The method of claim 12 wherein said second carbon concentration is 0.13%-0.22%.

14. The method of claim 13 wherein said second temperature is less than said first temperature.

* * * * *